US005625897A

United States Patent [19]

Park

[11] Patent Number: 5,625,897

[45] Date of Patent: May 6, 1997

[54] UPPER TORSO GARMENT

[76] Inventor: Kelly R. Park, 8790 Blue Jay La., Salt Lake City, Utah 84121

[21] Appl. No.: 583,777

[22] Filed: Jan. 11, 1996

[51] Int. Cl.[6] ..... A41D 3/00

[52] U.S. Cl. ..... 2/69; 2/88

[58] Field of Search ..... 2/69, 69.5, 88, 2/89, 115, 113, 104, 105, 108, 106, 46, 50, 51, 273; D2/718–720, 724, 861, 823, 824, 825, 826, 830, 828

[56] References Cited

U.S. PATENT DOCUMENTS

| | | | |
|---|---|---|---|
| D. 277,519 | 2/1985 | Silberman . | |
| D. 314,078 | 1/1991 | Wiedehold et al. . | |
| 719,899 | 2/1903 | Stacey | 2/89 |
| 1,024,957 | 4/1912 | Wein | 2/273 |
| 1,153,523 | 9/1915 | Salzenstein . | |
| 1,163,287 | 12/1915 | Van Raalte . | |
| 1,365,731 | 1/1921 | Schloss | 2/273 |
| 1,390,033 | 9/1921 | Henderson . | |
| 1,432,249 | 10/1922 | Hoyme . | |
| 1,497,685 | 6/1924 | Hoyme . | |
| 1,636,122 | 7/1927 | Brown . | |
| 1,733,555 | 5/1929 | Nutt . | |
| 1,929,263 | 10/1933 | Sork . | |
| 2,722,694 | 11/1955 | Bryant . | |
| 2,892,909 | 6/1959 | Darnutzer et al. . | |
| 3,781,916 | 1/1974 | Vitol . | |
| 4,764,985 | 8/1988 | Wade . | |
| 4,771,480 | 9/1988 | Stimson et al. . | |
| 4,780,911 | 11/1988 | Mack . | |
| 4,860,383 | 8/1989 | Warn . | |
| 4,924,527 | 5/1990 | Hintermeyer . | |
| 5,077,838 | 1/1992 | Senser | 2/108 |
| 5,259,068 | 11/1993 | Carroll | 2/88 |

FOREIGN PATENT DOCUMENTS

| | | |
|---|---|---|
| 191218 | 8/1937 | Germany . |
| 2115686 | 2/1983 | United Kingdom . |

OTHER PUBLICATIONS

Journal of AMA, vol. 168 No. 7 "Self–Adhering Nylon Tapes", Maurice Gershman, M.D.

*Primary Examiner*—C. D. Crowder
*Assistant Examiner*—Gloria Hale
*Attorney, Agent, or Firm*—Thorpe, North & Western, L.L.P.

[57] ABSTRACT

The invention is a garment. The garment is at least one sheet of flexible material having portions which drape over the wearer's shoulders, upper chest and upper back. The sheet has a center and at least one peripheral edge, an axis passes from the peripheral edge through the center to the peripheral edge opposite the center. The sheet has at least two slots formed at least partially through the axis. The at least two slots, which are between the center and the peripheral edge, are for receiving at least one arm of the wearer. The sheet has at least one inner edge formed about the center defining a central hole for insertion of the wearer's head.

A preferred embodiment of the garment has at least one slot disposed on each side of the center, the slots being disposed substantially equidistant from the center and between the center and the peripheral edge. Alternative embodiments of the present invention include: the material at least at the inner edge of the central hole being elastic; at least one slot extending substantially parallel with the peripheral edge; and, the sheet of material having an access slit extending from the central hole at least partially toward the peripheral edge.

28 Claims, 7 Drawing Sheets

UPPER TORSO GARMENT

BACKGROUND OF THE INVENTION

1. The Field of the Invention

The present invention pertains generally to the field of garments. More particularly, it concerns a garment capable of covering the upper torso of the wearer.

2. The Background Art

Garments have long been used for protection and as an indication of life style. Garments of differing sizes and shapes have evolved to meet the various protection and fashion needs of people including protecting the wearer from the elements and providing a wearer with a sense of comfort corresponding to their personal level of modesty. It is well recognized that garments have a number of uses.

Some garments are purely decorative or ornamental. However, purely decorative or ornamental garments offer usefulness and versatility.

A number of garments have developed in the prior art which, through their shape and size, lend themselves to specialized uses. One of the most widely known garments has been the bib, which is worn by people of all ages to protect clothing from falling food while the wearer is eating or drinking. Typically, a bib comprises an opening in a sheet of material for the wearer's head. Because bibs are often placed on small children, bibs are usually structured so that they may be placed on and removed with minimal effort. Additionally, bibs are designed to protect the front of the wearer, with substantially no material draped over the back and shoulders of the wearer.

In the prior art, other garments are known to have been devised to protect clothing, including: weightlifter's vests, hair cutting capes, mammography capes, dental patient hoods, and a number of bib-like chest protectors. None of these garments are known to have slots formed in sheet of material for receiving the wearer's arms. Additionally, none provide a hole for receiving the wearers head and protection for the shoulders as well as the back and front of the upper torso.

A substantial number of the garments (particularly protective garments) in the prior art cover the wearer to the waist or below. These garments lack the advantages of a garment which protects the upper torso, yet does not unnecessarily cover the lower body of the wearer. For example, a garment which covers the wearer to the waist or below may be undesirably warm or restrictive. Such clothing may be slow and awkward to put on or take off, and may be too heavy for warm weather.

OBJECTS AND SUMMARY OF THE INVENTION

It is therefore an object of the present invention to provide a garment which covers the upper torso of the wearer.

It is another object of the invention, in accordance with one aspect thereof, to provide such a garment which is easy and simple to manufacture.

It is another object of the invention, in accordance with one aspect thereof, to provide such a garment upon which a design may easily be placed.

It is another object of the invention, in accordance with one aspect thereof, to provide such a garment which is light weight and easy to put on and remove, and sufficiently, but not excessively, insulating.

It is another object of the invention, in accordance with one aspect thereof, to provide such a garment which accommodates the wearer's desire for modesty.

It is another object of the invention, in accordance with one aspect thereof, to provide such a garment which will protect the wearer from the sun, wind, and elements out-of-doors.

It is another object of the invention, in accordance with one aspect thereof, to provide such a garment which will protect the wearer from spills, drips, and dropped food.

It is another object of the invention, in accordance with one aspect thereof, to provide such a garment which may readily be placed over the wearer's head.

It is another object of the invention, in accordance with one aspect thereof, to provide such a garment which will remain on the wearer, and not flap up.

It is another object of the invention, in accordance with one aspect thereof, to provide such a garment which is substantially symmetrical.

It is another object of the invention, in accordance with one aspect thereof, to provide a garment which will open when twirled or spun.

The above objects and others not specifically recited are realized in a specific illustrative embodiment of an upper torso garment. The garment comprises a sheet of flexible material having portions which drape over the wearer's shoulders, upper chest and upper back. The sheet has a center and at least one peripheral edge, an axis passes from the peripheral edge through the center to the peripheral edge opposite the center. The sheet has at least two slots formed at least partially through the axis. The slots, which are between the center and the peripheral edge, receive at least one arm of the wearer. The sheet has a at least one inner edge formed about the center defining a central hole for insertion of the wearer's head.

A preferred embodiment of the garment has at least one slot disposed on each side of the center, the slots being disposed substantially equidistant from the center and between the center and the peripheral edge. Alternative embodiments of the present invention include: at least the material along the inner edge of the central hole being elastic; at least one slot extending substantially parallel to the peripheral edge; and, the sheet of material having an access slit, the slit extending either from the inner edge of the central hole at least partially toward the peripheral edge.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
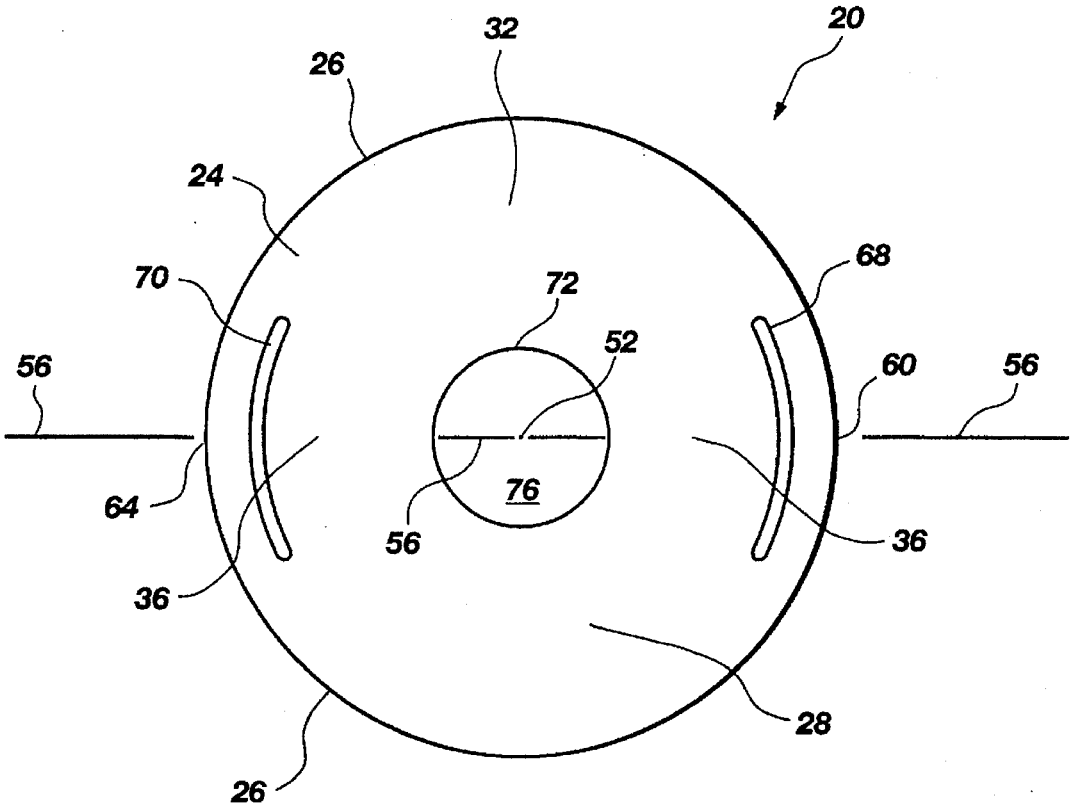
FIG. 1 is a top view of the upper torso garment made in accordance with the principles of the present invention.
Figure 1A:
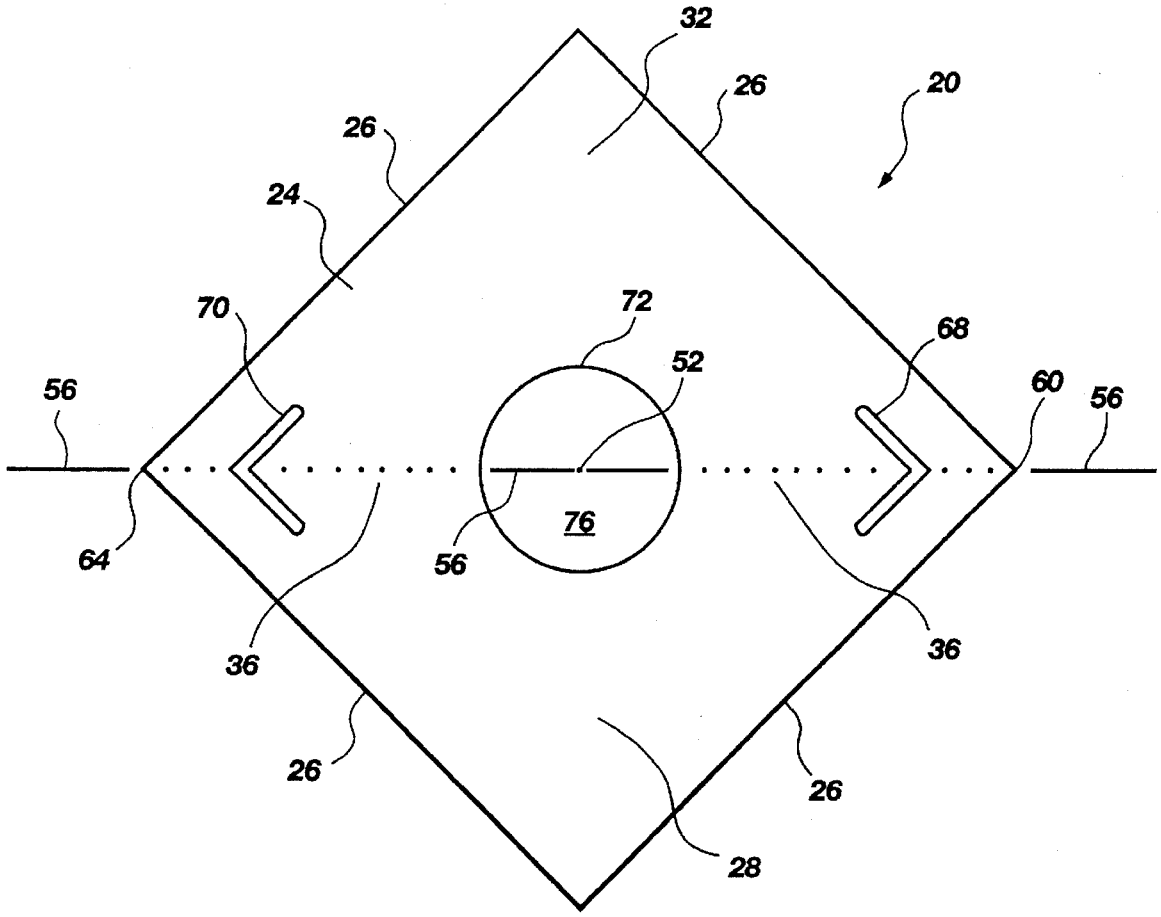
FIG. 1A is a top view of an alternative embodiment of the garment of FIG. 1.

A preferred illustrative embodiment in accordance with the present invention is of an upper torso garment generally designated at 20 in FIG. 1 for a wearer, such as a person or animal. An alternative of the preferred embodiment is shown in FIKG. 1A. Referring to FIGS. 1 and 1A, the garment 20 is shown compring a sheet 24 of flexible material having at least one peripheral edge 26. The material may comprise any of a number substances used form making garments, including: cotton, cotton blends, silk, silk blends, flax, flax blends, wool, wool blends, nylon, nylon blends, cellulose, cellulose bends, polyethylene, polyethylene blends, polyesters, polyester blends, rayon, rayon blends, rubber, rubber blends, and other substances used by those who are skilled in the art of garments. The substances may be used to form the sheet of flexible material by weaving, molding, pressing, rolling, extruding, pouring and other methods used by those skilled in the art of sheets and particularly the art of sheets for garments. Additionally, it will be recognized that pieces of material may be connected together to form a single sheet or sheets of material may be layered one upon another in the practice of the present invention. The term "sheet" is used in a broad sense, to include not only a continuous material but connected material, including sheets of material having holes or formed by: webbing, interlacing, crocheting, knitting, patch-working, gluing, stitching, and other means known in the art. Alternatively, the garment 20 may be seamless and configured such that the entire sheet 24 resides common to a single plane when in a natural, unfolded condition. Thus the garment 20 may be made both light weight, yet sufficiently though not excessively, insulating. Additionally, the substances selected for the sheet may be chosen because they bind well with inks, paints, dies, or otherwise readily receive colors.

Figure 9:
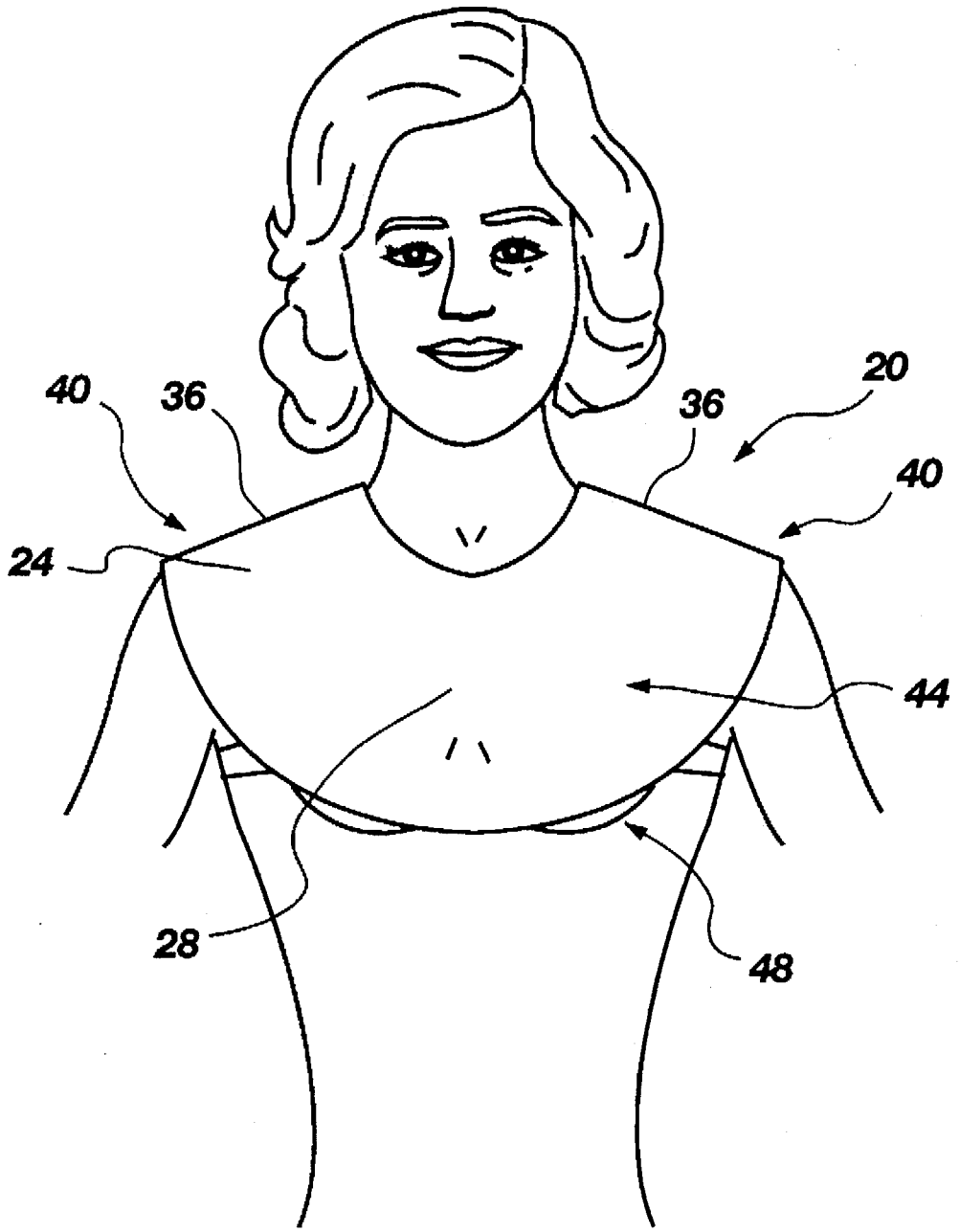
FIG. 9 is a frontal view of a person wearing the garment of FIG. 1.

The garment 20 has a front portion 28, a back portion 32, and shoulder portions 36. As shown in FIG. 9, these portions drape over the wearer's shoulders (generally indicated at 40), upper chest (generally indicated at 44) and upper back (not shown); thus providing versatile protection to the upper torso from the sun, wind and elements out-of-doors as well as protecting the upper torso from spills, drips, or dropped food. Additionally, The garment is of sufficient length to cover the upper torso of the wearer if the wearer is self conscious or modest, and desires to avoid exposure of their upper torso when, for example, wearing a bathing suit as indicated generally at 48 in FIG. 9.

Referring now to the preferred embodiment of FIG. 1, the sheet 24 has a center 52 and an axis 56. The axis 56 passes from a selected beginning point 60 on the peripheral edge 26 through the center 52 to a point 64 on the peripheral edge 26 on the opposite side of the center 52 from the beginning point 60. Thus, the axis 56 passes from the peripheral edge 26 through the center 52 to the peripheral edge 26 opposite the center 52. It will be noted that the axis 56 is substantially straight.

The garment 20 has at least two slots 68 and 70 and at least one inner edge 72 defining a central hole 76 formed in the sheet 24. The term "slot", as used herein, means an opening in the sheet 24 which does not pass through an edge, either an inner edge 72 or a peripheral edge 26. As shown in FIG. 1, the slots 68 and 70 are disposed between the inner edge 72 and the peripheral edge 26 and pass at least partially through the axis 56.

Figure 2:
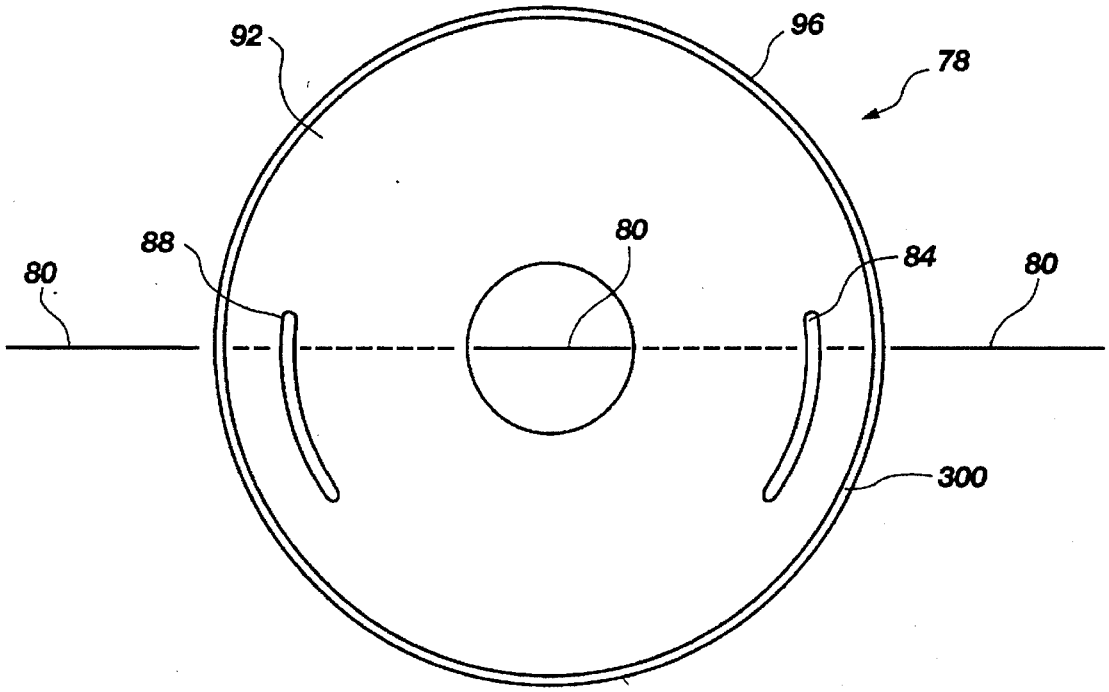
FIG. 2 is a top view of an alternative embodiment of the garment of FIG. 1.

While the axis 56 shown in FIG. 1 passes substantially through the middle of the slots 68 and 70, in the practice of the invention the axis 56 may pass trough any portion of the slots 68 and 70, as shown in the alternative embodiment of the present invention shown in FIG. 2. In FIG. 2 the garment is generally indicated at 78. The axis 80 passes through the slots 84 and 88 in the sheet 92. It will be noticed in FIG. 2 that the axis 80 does not pass through the middle of the slots 84 and 88.

Figure 7:
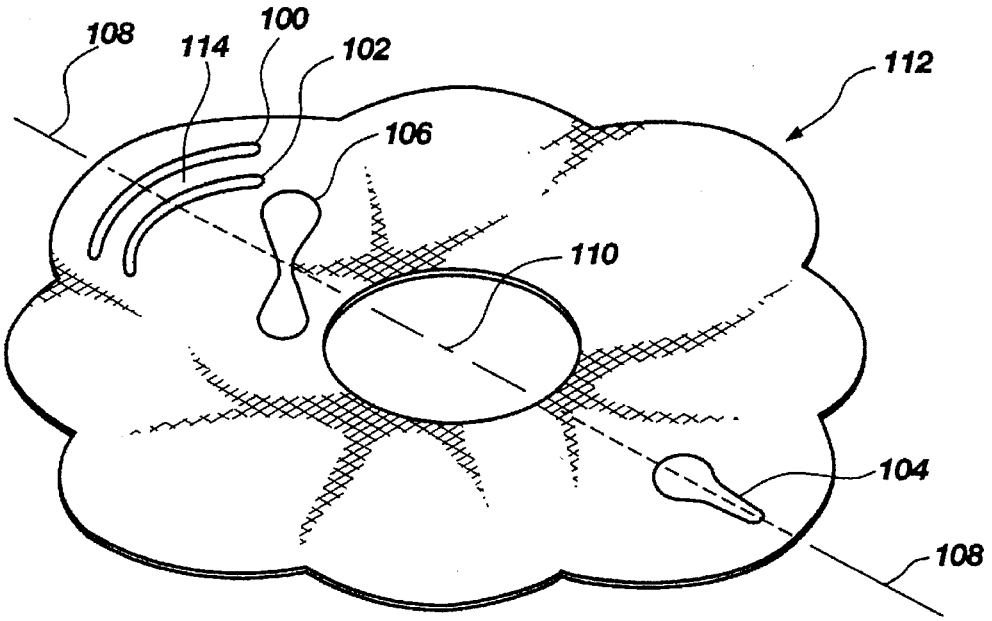
FIG. 7 is a top perspective view of an alternative embodiment of the garment of FIG. 1.

A number of alternative embodiments lend themselves to the present invention. FIG. 7 shows illustrative embodiments of slots, including the placing of multiple slots together (100 and 102), variation of the orientation of the slots (104 and 106), and variation of the shapes of slots (104 and 106) with respect to the axis 108 and the center 110 of the garment 112. It will further be noticed that where two slots 100 and 102 are substantially parallel a slat 114 is formed. A "slat" is a narrow flat strip of material which may receive the wearer's arm.

As shown in FIG. 1, the slots 68 and 70 are disposed between the center 52 and the peripheral edge 26. While it is not necessarily essential for the practice of the invention, in the preferred embodiment of the invention of FIG. 1 the slots 68 and 70 are disposed substantially equidistant between the center 52 and the peripheral edge 26. Thus, the distance from the center 52 to each of the slots 68 and 70 is approximately equivalent.

Figure 4:
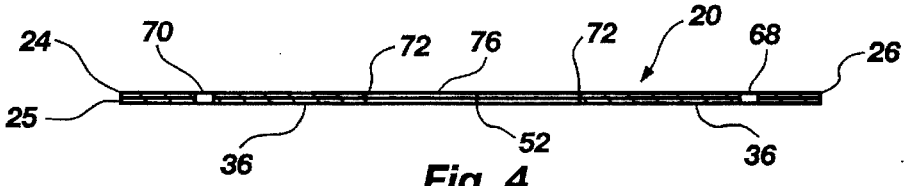
FIG. 4 is a side sectional view of an the garment of FIG. 1 along section line A—A.

Turning briefly to FIG. 4, which is a view of FIG. 1 sectioned along A-A, it will be noted that in addition to the sheet 24, one or more additional sheets 25 may be attached to the first sheet 24. The additional sheet 25 may be attached by one or more of the means known in the art, which includes: gluing, stitching, riveting, clamping, crimping, adhesive binding, interweaving, melting, molding, pressing, welding, fusing, and others.

FIGS. 1, 3, 5, and 6 show different embodiments of the present invention, having different shapes, which may include: circular, semi-circular, triangular, square, rectangular, pentagonal, hexagonal, heptagonal, octagonal, and any other regular or irregular shape. As indicated and is well understood, the shape of the present invention may differ and a wide variety of shapes are possible.

Figure 3:
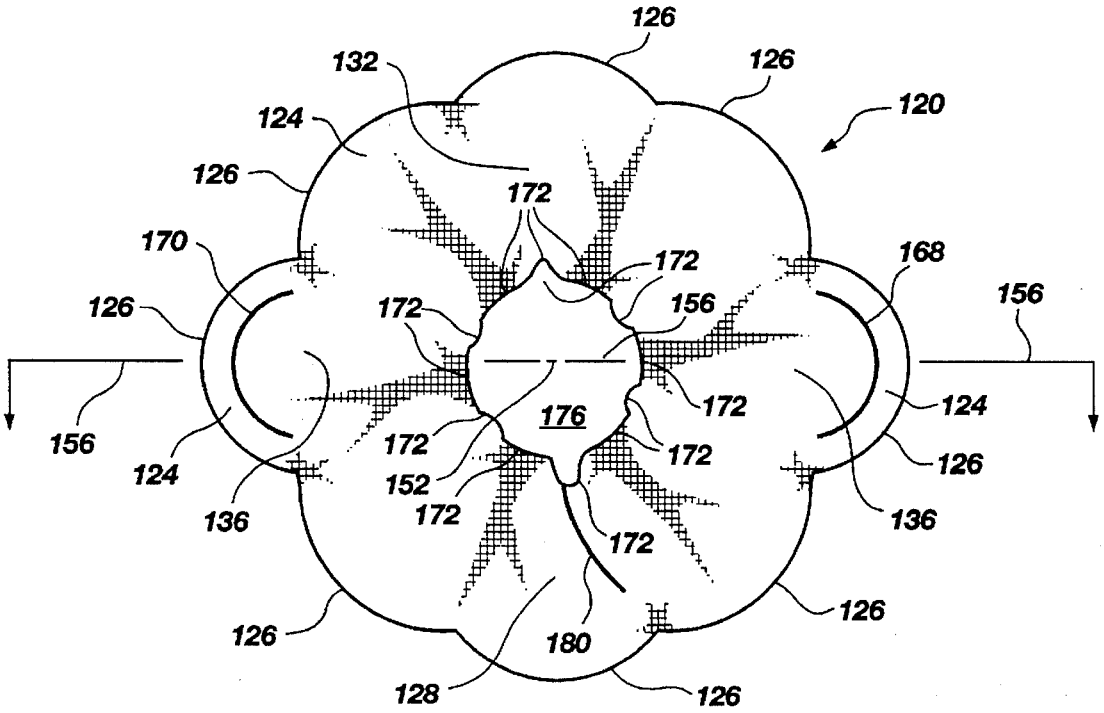
FIG. 3 is a top view of an alternative embodiment of the garment of FIG. 1.

Illustratively, the alternative embodiment of the present invention is shown in the top view shown in FIG. 3. The upper torso garment is generally designated at 120. The garment 120 comprises a sheet 124 of flexible material having a plurality of peripheral edges 126. The garment 120 has a front portion 128, a back portion 132, and shoulder portions 136. These portions drape over the wearer's shoulders, upper chest, and upper back as previously indicated.

The sheet 124 has a center, indicated at 152 and an axis 156, as previously described regarding FIG. 1. The garment 120 shown in FIG. 3 has at least two slots 168 and 170 and a plurality of inner edges 172 defining a central hole 176 formed in the sheet 124. The axis 156 passes trough at least a portion of the slots 168 and 170, and the slots 168 and 170 are disposed between the center 152 and the peripheral edges 126.

As will be appreciated, the plurality of peripheral edges 126 and the plurality of inner edges 172, as shown in FIG. 3, just as the peripheral edge 26 an inner edge 72 of FIG. 1, may be made by one skilled in the art in a wide variety number of shapes without departure from the scope of the present invention. Additionally, the slots 68 and 70 of FIG. 1 and 168 and 170 of FIG. 3 extend substantially parallel with the at least one peripheral edge 26 and 126 respectively.

In the alternative embodiment of FIG. 3 is shown an access slit 180 extending from an inner edge 172 of the central hole 176 at least partially toward a peripheral edge 126. The term "slit", as used herein, means an opening in the sheet 124 which passes through the inner edge 172 extending, at least partially, toward a peripheral edge 126. As shown in FIG. 3, the slit 180 is not necessarily straight, nor does it necessarily pass through the peripheral edge. However, as shown in the alternative embodiment 182 of FIG. 6, the slit 184 may pass from and through an inner edge 186 and also a peripheral edge 188.

Figure 6:
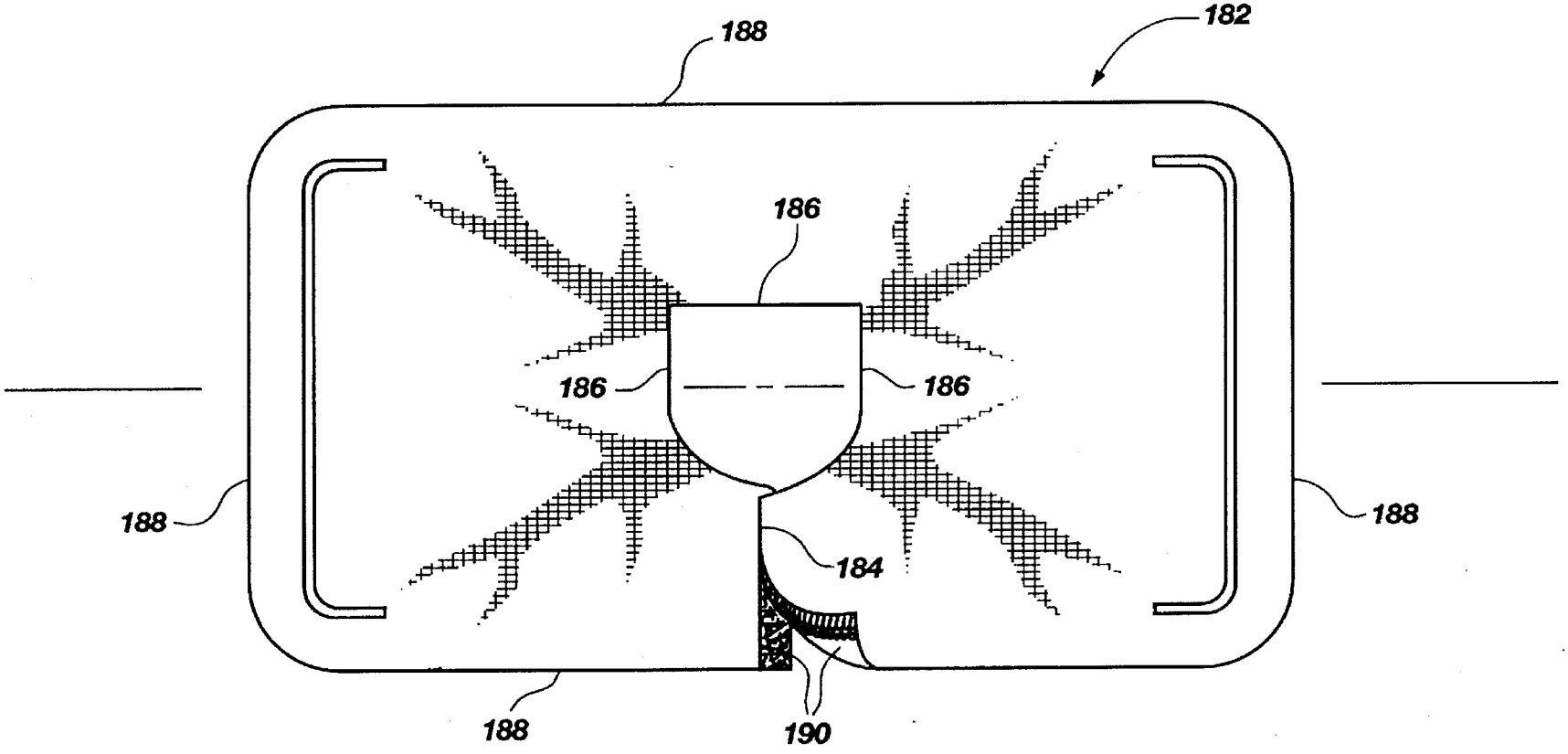
FIG. 6 is a top view of an alternative embodiment of the garment of FIG. 1.

Furthermore, FIG. 6 shows the garment 182 comprises a closing means 190 for closing at least a portion of the slit 184. The closing means may be any means whereby any portion or all of the slit 184 may be held closed; including: (1) at least one button and loop, (2) at least one hook and loop, (3) at least one button and hole, (4) at least one VELCROυ hook and loop fastener; strip, (5) at least one pair tie cords, (6) at least one tie cord and anchor, (7) at least one interlocking loop, (8) at least one buckle, (9) at least one latch, (10) at least one snap, (11) at least one clasp, and, (12) at least one zipper.

FIG. 4 shows a top view of another alternative embodiment of the present invention, wherein the upper torso garment is generally designated at 220. As previously, the garment 220 comprises at least one sheet 224 having at least one peripheral edge 226 and at least one inner edge 272 defining a central hole 276. In this embodiment, the material along at least the inner edge of the central hole is at least partially elastic, as indicated at 280. It will be appreciated by those skilled in the art that the term "elastic", as used in this application, is to be broadly construed to mean either the fabric is composed of elastic fibers or an elastic material is sewn into or connected to the fabric so as to allow the material to behave in an elastic manner. The elastic 280 of the inner edge 272 makes it easier for a person to place their head through the central hole 276.

Additionally, it is recognized that it would be an advantage the garment 220 not flap. "Flapping" occurs when portions of a garment which drape the wearer's body move in an undesirable manner during the wearer's activities, such as jumping or running, or where the garment is exposed the elements, such as wind. Referring to FIG. 1, when flapping occurs the front portion 28 or the back portion 32 of the garment 20 may rise up toward the wearer's head, or away from the wearer's body. Therefore, alternative embodiments of the present invention reduce or limit the degree of flapping which may arise.

One embodiment which reduces flapping is a weight means, shown in FIG. 2 at 300. The weight means 300 is attached along al least a portion of the peripheral edge, distributing the weight along the edge and thereby reducing flapping. The weight means 300 comprises material selected from the group consisting of: strips, beads, pellets, rods, rings, washers, hooks, and other objects known to those skilled in the art which may be attached to, sewed to, or sewed into the peripheral edge 96 of the garment 78 and thereby weight the garment 78 sufficiently to prevent flapping.

An additional advantage to the distribution of weight means 300 along the peripheral edge 96 of the garment 78, is that when the garment is spun or twirled, the centripetal force applied to the mass of the weight means 300 along the peripheral edge 96 will cause the garment 78 to rise and open. Thus, when the wearer spins or throws the garment 78 it will rise and the peripheral edge 96 will open, providing a festive appearance and entertaining activity.

Figure 5:
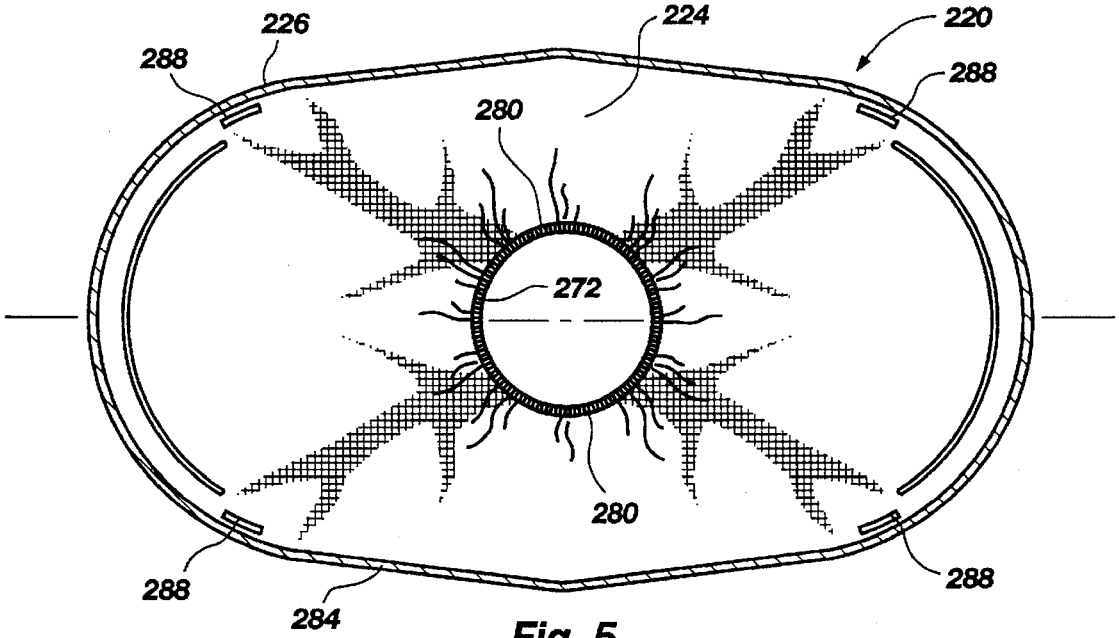
FIG. 5 is a top view of an alternative embodiment of the garment of FIG. 1.

Another embodiment, shown in FIG. 5 is elastic, indicated at 284. This embodiment, the material along at least a portion of the peripheral edge 226 is also at least partially elastic. The elastic 284 of the peripheral edge 226 helps to hold the garment 220 close to the upper torso of the wearer.

Additionally, FIG. 5 shows an attachment means 288 disposed at the peripheral 226 whereby at least a portion of the peripheral edge may be attached to another portion of the peripheral edge. The illustrative embodiment shown in FIG. 5 shows the attachment means 226 as strips of mating VELCRO™ hook and loop fastener; however, it will be appreciated by one skilled in the art that the attachment means 226 may comprise a means selected from the group consisting of: button and loop, hook and loop, button and hole, tie cords, tie cord and anchor, interlocking loop, buckle, latch, snaps, clasp, zipper, and other similar joining or attaching means known in the art of garments. The attachment means is another way whereby the garment is held close to the upper torso of the wearer.

Figure 8:
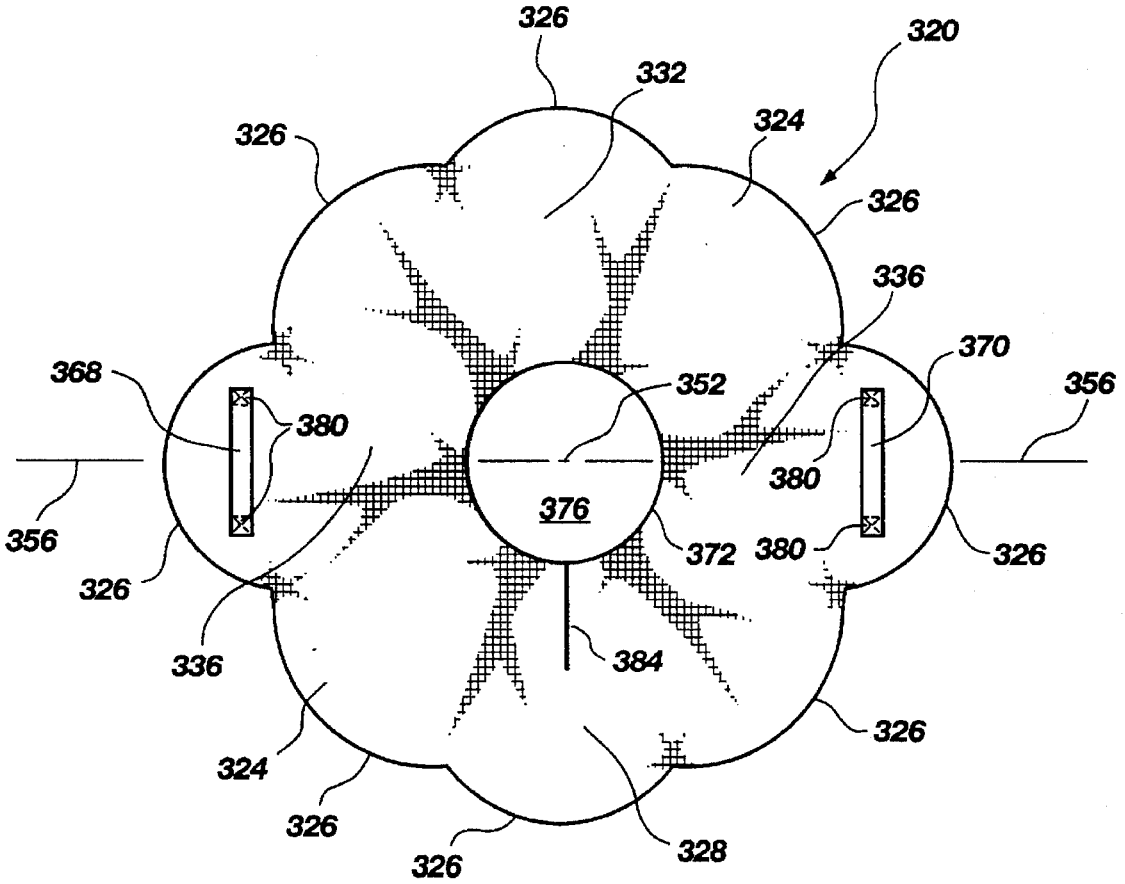
FIG. 8 is a top view of an alternative embodiment of the garment of FIG. 1.

In addition to the slat 114 being formed by two slots 100 and 102 as shown in FIG. 7 in it is an additional embodiment of the present invention, shown in FIG. 8. In FIG. 8 the upper torso garment is generally designated at 320. The garment 320 comprises a sheet 324 of flexible material and is shown having a plurality of peripheral edges 326, albeit the invention may be practiced with at least one peripheral edge. The garment 320 has a front portion 328, a back portion 332, and shoulder portions 336. These portions drape over the wearer's shoulders, upper chest, and upper back as previously indicated.

The sheet 324 has a center, indicated at 352 and an axis 356, as previously described regarding FIG. 1. The garment 320 shown in FIG. 8 has at least two slats 368 and 370 and at least one inner edge 372 defining a central hole 376 formed in the sheet 324. The axis 356 passes through at least a portion of the slots 368 and 370, and the slats 368 and 370 are disposed between the center 352 and the peripheral edges 326. As in FIG. 7, the slat 114 may be formed between slots 100 and 102; or, as shown in FIG. 8, the slats 368 and 370 may separately attached bands which are connected by connecting means 380 which attach the bands 368 and 370 to the sheet 324. The connecting means 380 comprises a means selected from the group consisting of: gluing, stitching, riveting, clamping, crimping, adhesive binding, interweaving, melting, molding, pressing, welding, fusing, and such other means as are known to those skilled in the art.

As in other embodiment discussed above, the invention as shown in FIG. 8 may further include elastic material at least along a portion of the inner edge 372 of the central hole 376, or a slit 384 (which may include a closing means) extending from the inner edge 372 at least partially toward the at least one peripheral edge 326, to ease placement of the garment 320 over the wearers head.

The present invention has the advantage of being simple to manufacture. A preferred method of making the garment of the present invention comprises the steps of:

(a) forming at least one sheet of flexible material having portions thereof to drape over a wearer's shoulders, upper chest and upper back, said at least one having a center and at least one peripheral edge, an axis passing from the at least one peripheral edge through the center to the at least one peripheral edge opposite the center;

(b) forming at least one inner edge about the center of said at least one sheet, said inner edge defining a central hole in said at least one for insertion of the wearer's head;

(c) forming at least two slots in said at least one sheet, said slots passing at least partially through said axis on each side of the center, said slots being disposed between the at least one inner edge and the at least one peripheral edge for receiving the arms of the wearer when the wearer's head is inserted through the central hole; and may also include the step of, (d) applying at least one color to said material. As will be appreciated, the manufacture of the present invention is very straight forward. Moreover, the method of manufacture affords a number of options. It should be noted that the steps of the manufacture may occur in any order; either steps may occur independently or in combination. Illustratively, the slots and center hole may be formed at the time the sheet is formed. Color may be applied to the material at any time including: adding color at the time the material is being formed; adding color after the material is formed but before forming the inner edge; adding color at the same time the inner edge is formed; adding color after the inner edge is formed but before the slots are formed; adding color at the time the slots are formed; or, adding color after the slots are formed; and similarly, the inner edge, peripheral edge, and slots may also be formed in differing orders or in combination.

Those skilled in the art will appreciate from the preceding disclosure that the objectives stated above are advantageously achieved by the present invention.

While the present invention is described in terms of an upper torso garment, it is to be understood that the subject apparatus and method may be used in any field of clothing application. Those having ordinary skill in the field of this invention will appreciate the advantages of the invention, and its application to a wide variety of garment uses.

As clearly shown in FIG. 1, the flexible sheet 24 is preferably seamless, and resides common to a single plane when disposed in a naturally biased, unfolded position as in FIG. 1. With the slots 68 and 70 being formed in opposing sides of the central hole 76, they reside facing each other in a broadside-facing-broadside noncollinear relationship when the sheet 24 is disposed in its naturally biased, unfolded position shown in FIG. 1, such that an imaginary straight line represented by axis 56 simultaneously intersects the central hole 76 and the slots 68 and 70 while extending in a nonparallel orientation with respect to said slots. Of course, the term "collinear" refers to its common, ordinary dictionary meaning, such as "lying in the same straight line." Webster's College Dictionary 267 (Random House, Inc. 1991). More preferably and as illustrated in FIG. 1, the straight line axis 56 laterally intersects a middle-third portion of the slots 68 and 70, and both slots 68 and 70 are preferably arcuate and reside common to a single circle surrounding the central hole 76 in a substantial co-axial orientation with said central hole, as shown in FIG. 1.

As shown in FIG. 9, the sheet 24 is preferably insufficient in length to extend to a wearer's waist when the wearer's head is inserted through the central hole 76. And as shown in FIGS. 1 and 9, the slots 68 and 70 are defined by edges of the material, and the central hole 76 and the slots are positioned such that the sheet 24 is capable of draping over the wearer's shoulders 40 in a substantially unruffled configuration while the edges defining the slots surround the wearer's shoulder and armpit region.

It is to be understood that the above-described arrangements are only illustrative of the application of the principles of the invention. Numerous modifications and alternative arrangements may be devised by those skilled in the art without departing from the spirit and scope of the present invention and the appended claims are intended to cover such modifications and arrangements.

What is claimed is:

1. A garment comprising:

at least one sheet of flexible material having portions thereof to drape over the wearer's shoulders, upper chest and upper back, said at least one sheet having a center, a central hole formed therein and at least one peripheral edge, wherein a straight axis extends from a first portion of the at least one peripheral edge through the center to a second portion of the at least one peripheral edge opposite said first portion;

at least one inner edge defining the central hole for insertion of the wearer's head; and, wherein the sheet resides common to a single plane when disposed in a naturally biased, unfolded position and includes at least two slots formed therein on opposing sides of the central hole such that when the sheet is disposed in the naturally biased, unfolded position said slots face each other in a broadside-facing-broadside noncollinear relationship and such that said axis simultaneously intersects the central hole and the first and second slots while extending in a nonparallel orientation with respect to said slots, said slots being disposed between the at least one inner edge and the first and second portions of the at least one peripheral edge respectively, the sheet, central hole and slots being configured and dimensioned to enable the wearer's arms to extend through the slots when the wearer's head is inserted through said central hole.

2. The garment as in claim 1, wherein said garment has at least one slot disposed on each side of the center, said slots being disposed substantially equidistant between the center and between the center and the at least one peripheral edge.

3. The garment as in claim 1, wherein the material along the at least one inner edge defining said central hole is formed from at least partially elastic material.

4. The garment as in claim 1, wherein the sheet of flexible material is seamless and configured such that said entire sheet resides common to a single plane when in a natural, unfolded condition.

5. The garment as in claim 1, wherein said at least one slot extends substantially parallel with said at least one peripheral edge.

6. The garment as in claim 1, wherein said garment further comprises:

the at least one sheet of material having an access slit extending from the at least one inner edge defining the central hole at least partially toward the at least one peripheral edge.

7. The garment as in claim 6, wherein said garment further comprises:

closing means for closing at least a portion of said access slit.

8. The garment as in claim 7, wherein said closing means selected from the group consisting of:

(1) at least one button and loop, (2) at least one hook and loop, (3) at least one button and hole, (4) at least one hook and loop fastener, (5) at least one pair of tie cords, (6) at least one tie cord and anchor, (7) at least one interlocking loop, (8) at least one buckle, (9) at least one latch,

(10) at least one snap,

(11) at least one clasp, and

(12) at least one zipper.

9. The garment as in claim 1, wherein the material along at least one peripheral edge is at least partially elastic.

10. The garment as in claim 1, wherein the garment further comprises:

attachment means for attaching at least a portion of the at least one peripheral edge to another portion of the at least one peripheral edge.

11. The garment as in claim 1, wherein the garment further comprises:

weight means disposed at least at one peripheral edge for distributing weight at least partially along said at least one edge.

12. A garment comprising:

at least one sheet of flexible material having portions thereof to drape over the wearer's shoulders, upper chest and upper back, said at least one sheet having a center, a central hole formed therein and at least one peripheral edge, a straight axis extending from a first portion of the at least one peripheral edge through the center to a second portion of the at least one peripheral edge opposite said first portion;

at least one inner edge defining the central hole for insertion of the wearer's head, the material around the at least the inner edge of said central hole being at least partially elastic; and, wherein the sheet resides common to a single plane when disposed in a naturally biased, unfolded position and includes at least two slots formed therein on opposing sides of the central hole such that when the sheet is disposed in the naturally biased, unfolded position said slots face each other in a broadside-facing-broadside noncollinear relationship such that said axis simultaneously intersects the central hole and the first and second slots while extending in a nonparallel orientation with respect to said slots, said slot being positioned on opposing sides of the center and substantially equidistant from the center, at least two slots being disposed between said at least one inner edge and the first and second portions of the at least one peripheral edge respectively, the sheet, central hole and slots being configured and dimensioned to enable the wearer's arms to extend through the slots when the wearer's head is inserted through said central hole, each said slot extending substantially parallel with said at least one peripheral edge.

13. The garment as in claim 12, wherein said garment further comprises:

the at least one sheet of material having an access slit at least partially extending from the at least one inner edge of the central hole toward the at least one peripheral edge.

14. The garment as in claim 12, wherein said slit extends from the at least one inner edge of the central hole through the at least one peripheral edge.

15. The garment as in claim 12, wherein said garment further comprises:

closing means for closing at least a portion of said access slit.

16. A garment comprising:

at least one sheet of flexible material having portions thereof to drape over the wearer's shoulders, upper chest and upper back, said at least one sheet having a center, a central hole formed therein and at least one peripheral edge and an axis extending from a first portion of the at least one peripheral edge through the center to a second portion of the at least one peripheral edge opposite said first portion;

at least one inner edge defining the central hole for insertion of the wearer's head; and, at least two bands separately attached to the sheet on opposing sides of the center, said bands passing at least partially through said axis, said bands being disposed between the at least one inner edge and the first and second portions of the at least one peripheral edge respectively, the sheet, central hole and bands being configured and dimensioned to enable the wearer's arms to extend between the bands and the sheet when the wearer's head is inserted through said central hole.

17. The garment as in claim 16, wherein said slats attached to the sheet by connecting means, wherein said connecting means is selected from the group consisting of:

(1) gluing, (2) stitching, (3) riveting, (4) clamping, (5) crimping, (6) adhesive binding, (7) epoxy binding, (8) interweaving, (9) melting,

(10) molding,

(11) pressing,

(12) welding, and

(13) fusing.

18. The garment as in claim 16, wherein the material at the at least one inner edge defining said central hole is formed from at least partially elastic material.

19. The garment as in claim 16, wherein said garment further comprises:

the at least one of material having an access slit extending from the at least one inner edge of the central hole at least partially toward the at least one peripheral edge.

20. The garment as in claim 19, wherein said garment further comprises:

closing means for closing at least a portion of said access slit.

21. A method of making a garment comprising the steps of:

(a) selecting at least one sheet of flexible material having portions thereof to drape over a wearer's shoulders, upper chest and upper back, said at least one sheet having a center, a central hole formed therein and at least one peripheral edge, a straight axis extending from a first portion of the at least one peripheral edge through the center to a second portion the at least one peripheral edge opposite said first portion, wherein said sheet resides common to a single plane when disposed in a naturally biased, unfolded position;

(b) forming at least one inner edge defining a central hole in said at least one sheet for insertion of the wearer's head; and, (c) forming at least two slots in said at least one sheet on opposing sides of the central hole such that when the sheet is disposed in the naturally biased, unfolded position said slots face each other in a broadside-facing-broadside noncollinear relationship such that said axis simultaneously intersects the central hole and the first and second slots while extending in a nonparallel orientation with respect to said slots, said slots being disposed between the at least one inner edge and the first and second portions of at least one peripheral edge respectively, the sheet, central hole and slots being configured and dimensioned to enable the wearer's arms to extend through the slots when the wearer's head is inserted through said central hole.

22. The method as in claim 21, further comprising the step of: applying at least one color to said sheet.

23. The garment as defined in claim 1, wherein both slots are arcuate and reside common to a single circle surrounding the central hole in a substantial co-axial orientation with said central hole.

24. A garment comprising:

a seamless sheet of flexible material which resides common to a single plane when disposed in a naturally biased, unfolded position;

wherein said seamless sheet further includes a central opening formed therein and first and second slots formed therein on opposing sides of said central opening such that when said seamless sheet is disposed in the naturally biased, unfolded position said slots face each other in a broadside-facing-broadside noncollinear relationship and such that an imaginary straight line simultaneously intersects the central opening and the first and second slots while extending in a nonparallel orientation with respect to said slots.

25. The garment as defined in claim 24, wherein the imaginary straight line laterally intersects a middle-third portion of both the first and second slots.

26. The garment as defined in claim 24, wherein both slots are arcuate and reside common to a single circle surrounding the central opening in a substantial co-axial orientation with said central opening.

27. The garment as defined in claim 24, wherein the sheet is insufficient in length to extend to a wearer's waist when the wearer's head is inserted through the central opening.

28. The garment as defined in claim 24, wherein the slots are defined by edges of the material, and wherein the central opening and the slots are positioned such that the sheet is capable of draping over a wearer's shoulders in a substantially unruffled configuration while the edges defining the slots surround the wearer's shoulder and armpit region.

* * * * *